United States Patent [19]

Shehan et al.

[11] Patent Number: 5,065,461

[45] Date of Patent: Nov. 19, 1991

[54] SWIMMING POOL AND COVER

[76] Inventors: Billy C. Shehan; Billy C. Shehan, Jr., both of 298 E. Mt. Zion Road, Independence, Ky. 41051; Thomas R. Stubbeman, 309 Main St., Highland Heights, Ky. 41076

[21] Appl. No.: 488,308

[22] Filed: Mar. 5, 1990

[51] Int. Cl.[5] ..... E04H 4/14

[52] U.S. Cl. ..... 4/503; 4/506

[58] Field of Search ..... 4/488, 498, 499, 500, 4/501, 502, 503, 496, 506

[56] References Cited

U.S. PATENT DOCUMENTS

| | | | |
|---|---|---|---|
| 2,517,393 | 8/1950 | Law | 4/503 X |
| 2,755,484 | 7/1956 | Hotz | 160/392 X |
| 2,870,454 | 1/1959 | Schippert et al. | 4/503 |
| 2,914,776 | 12/1959 | Hotz | 4/499 X |
| 3,063,062 | 11/1962 | Logan | 4/499 |
| 3,177,501 | 4/1965 | Kwake | 4/503 X |
| 3,310,814 | 3/1967 | Lipman | 4/506 X |
| 3,347,006 | 10/1967 | Fox | 4/488 X |
| 3,419,916 | 1/1969 | Schankler | 4/506 X |
| 3,427,663 | 2/1969 | O'Connell et al. | 52/588 |
| 3,512,326 | 5/1970 | Greene | 4/488 X |
| 3,524,291 | 8/1970 | Rozanski | 4/506 X |
| 3,535,840 | 10/1970 | Fontana | 4/506 X |
| 3,555,573 | 1/1971 | Turner | 4/498 |
| 3,628,198 | 12/1971 | Katzman | 4/488 X |
| 3,667,071 | 6/1972 | Hoch et al. | 4/506 X |
| 3,750,197 | 8/1973 | Weir et al. | 52/169.7 |
| 3,906,688 | 9/1975 | Witte | 52/152 |
| 3,938,199 | 2/1976 | Laven | 4/506 X |
| 3,975,874 | 8/1976 | Witte et al. | 52/169.7 |
| 4,004,386 | 1/1977 | Diffenderfer | 4/506 X |
| 4,011,607 | 3/1977 | Davidoff | 4/503 |
| 4,047,340 | 9/1977 | Witte et al. | 52/169.7 |
| 4,064,571 | 12/1977 | Phipps | 4/496 X |
| 4,107,826 | 8/1978 | Tysdal | 4/498 |
| 4,158,244 | 6/1979 | Stefan | 4/496 |
| 4,197,595 | 4/1980 | Dearing | 4/503 |
| 4,203,170 | 5/1980 | Lankheet | 4/506 |
| 4,229,844 | 10/1980 | Cribbean et al. | 4/506 X |
| 4,335,474 | 6/1982 | Bailey | 4/506 |
| 4,429,425 | 2/1984 | Weir et al. | 4/503 |
| 4,457,119 | 7/1984 | Dahowski | 4/506 X |
| 4,603,521 | 8/1986 | Engelhart | 4/506 X |
| 4,713,849 | 12/1987 | Kindness | 4/496 |
| 4,967,424 | 11/1990 | Stegmeier | 4/496 |
| 4,980,934 | 1/1991 | Dahowski et al. | 4/496 |

FOREIGN PATENT DOCUMENTS

| | | | |
|---|---|---|---|
| 2336941 | 2/1974 | Fed. Rep. of Germany | 4/500 |
| 2214799 | 9/1989 | United Kingdom | 4/498 |

OTHER PUBLICATIONS

"Fiberstars Vinyl Liner".

"Torlan Pool Products, Inc." Flyer for Winter Cover--One Page and Associated Drawing-One Page.

*Primary Examiner*—Henry J. Recla

*Assistant Examiner*—Robert M. Fetsuga

*Attorney, Agent, or Firm*—Wood, Herron & Evans

[57] ABSTRACT

An improved swimming pool construction and cover includes a swimming pool cover laid on the water of the pool and having a marginal edge provided with one component of the two component elongated locking member. The second component of the locking member is disposed in the pool coping or deck edge accessible at the pool interior for engagement by the locking member component on the pool cover. The locking component associated wit the pool is provided in a retrofit configuration by securing a locking component to a vinyl liner bead lock secured in the vinyl liner bead channel in a pool coping. In a new vinyl-lined pool construction, a coping is provided with a secondary channel with one component of the cover locking member secured therein. In a gunnite pool, a channel is formed in the deck edge and a component of the releasable cover locking member is secured in the channel for securement of the pool cover thereto. Apparatus and methods are disclosed.

14 Claims, 2 Drawing Sheets

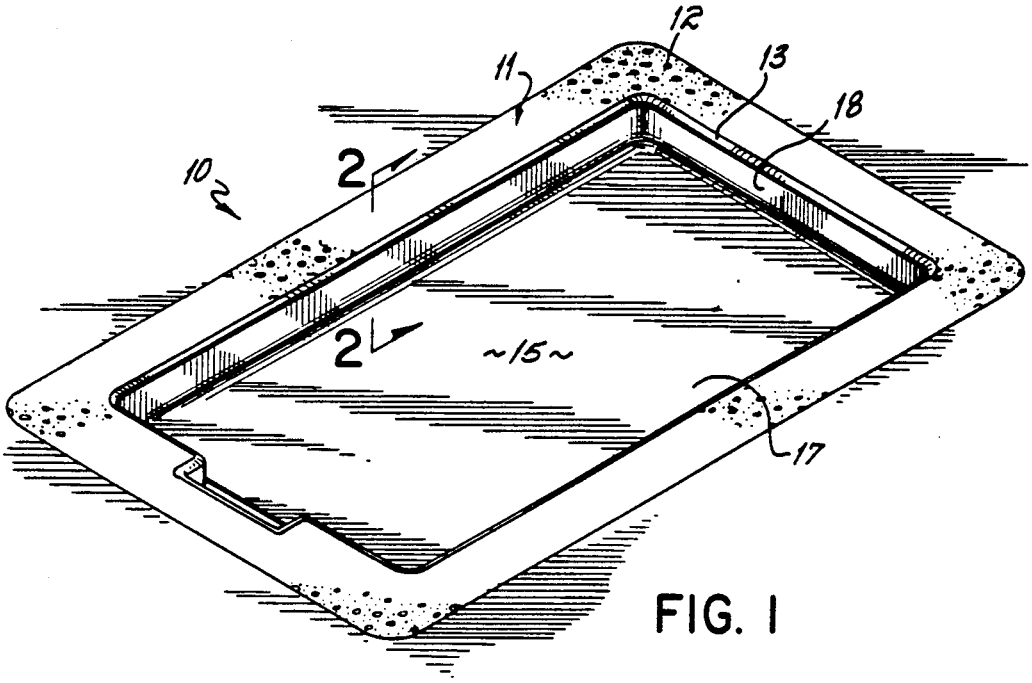
FIG. 1
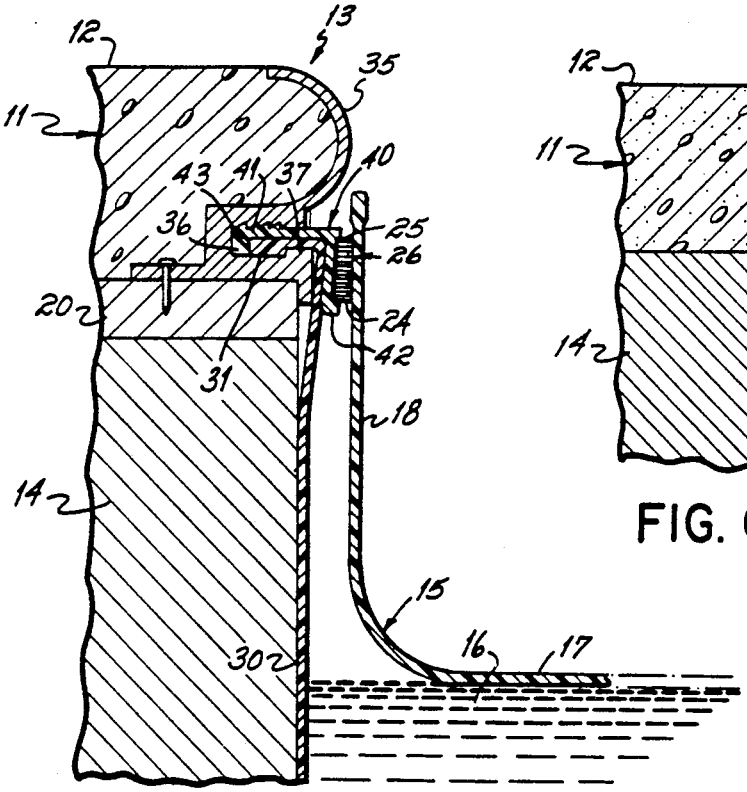
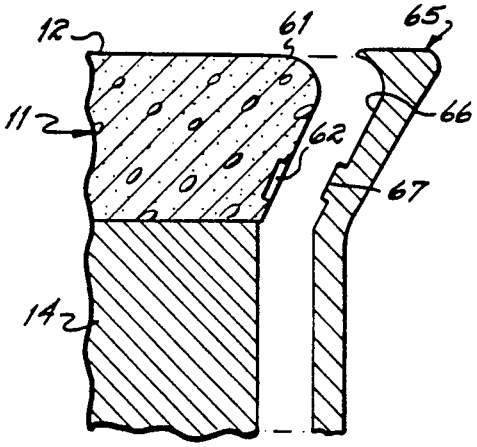
FIG. 6
FIG. 2

SWIMMING POOL AND COVER

This invention relates to swimming pool covers and more particularly to apparatus for releasably attaching swimming pool covers in deployed condition over a pool.

Many installed swimming pools today are of either gunnite or vinyl liner construction. Covers for both are desirable, particularly during any non-use season, such as winter, but as well for maintaining water temperature during short periods of non-use. Such covers serve to block debris from entering the water, and may serve as a safety factor.

In the past, numerous cover securing systems have been devised. Known systems, however, can be very expensive, and whether or not expense is considered, they may present significant use and maintenance problems.

For example, one current cover is designed to lay over a pool and has an edge portion lying on the adjacent pool deck. The edges of the cover are secured to tie-down points disposed on the deck. Such covers can be very expensive. Moreover, moisture, debris and other items can migrate or be blown under the cover, between the cover and deck surface where the moisture does not readily dry. This can cause staining of the pool deck. Also, water can migrate into cracks or voids in the deck surface and winter-time freeze-thaw cycles can cause the surface to chip, crack or slough away.

In another form of widely-used cover, water bags are used to hold down the cover edge portions on the deck surface. This is even more conducive to staining, deck degradation and the like. The presence of moisture, which does not readily dry, between the cover and deck is highly undesirable. Also, the water bags themselves are frequently difficult or worrisome to deal with, and occasionally leak.

In both these instances, the covers are secured to keep them from blowing away, while at the same time securing the pool. Of course, where the cover is stretched, its weight and loading must be accommodated by the securing devices or bags even when the cover may touch the pool water in the middle. This loading can be significant in a high wind.

Accordingly, it is desirable to provide an improved pool cover and mounting apparatus which does not present these problems, yet is still capable of securing the cover in operative disposition with regard to the pool.

Another consideration concerning pool covers is whether or not the cover is furnished as part of an original pool installation, or as an after construction purchase or retrofit.

If the pool is installed prior to any consideration given to the cover, a retrofit might require further construction inside the pool, or on the pool deck, causing dust, dirt and other debris to enter the pool system.

In the vinyl-lined pools, it is typical to use a coping forming and comprising the upper edge of the pool extending around the pool wall. Frequently, the coping will be set on the wall top, and a concrete deck will be poured around the pool, the coping serving as a form, which remains in place, for the deck edge surrounding the pool.

Such copings are frequently provided with a longitudinally extending channel in the coping's lower edge. The vinyl liner has a bead which is disposed in the channel just above the pool wall. This bead secures the liner in place above the projected water surface. It is also known to provide an additional channel in the coping for securing a dome structure over the pool. There are no known provisions in this construction for a cover of the type extending across the pool proximate the water level or between the pool walls.

In the gunnite pool, gunnite forms the pool walls and concrete or a concrete and gunnite or other material combination forms the pool deck. Frequently, the pool deck edge is poured in a cantilevered disposition over the water. In each of such pool constructions, covers of the foregoing types are used, with the attendant problems.

Accordingly, it has been one objective of this invention to provide an improved pool cover with improved means of securing the cover to the pool structure.

Another objective of this invention has been to provide an improved pool cover with improved means for releasably attaching the cover to the pool, and which can be provided as a retrofit or as original construction apparatus.

A further objective of the invention has been to provide an improved pool cover and cover attachment means for use in a gunnite pool having a cantilevered deck edge.

A further objective of the invention is the provision of a single pool cover and means for attaching the cover to a pool either as a retrofit or originally supplied cover for vinyl-lined pools or for gunnite pools.

A still further objective of the invention has been to provide pool structure and pool construction methods involving improved pool covers and releasable pool cover attachment means.

To these ends, the invention contemplates use of an elongated, two-component releasable locking member to secure the edge of a cover to the upper pool edge structure while the cover primarily rests on the water surface. One embodiment of the invention includes a retrofit pool cover and releasable attachment apparatus for a vinyl-lined pool. An elongated liner bead lock has one horizontally disposed leg for insertion into a deck coping channel to lock the liner bead therein, and a second vertical leg to which is secured one component of an elongated releasable locking member, such as a hook and loop fastener ("velcro") or similar, flexible post fasteners of the 3M Company ("Dual-Lock"). A pool cover is provided at a marginal edge with another component of the releasable locking member. The cover is laid across the water in the pool and the cover edges adjacent the pool's walls extending upwardly so the portions of the locking members can be engaged, thereby securing the cover to the pool. The pool cover is thus easily retrofitted to existing vinyl-lined pools.

In another embodiment o the invention for use in original vinyl-lined pool constructions, a deck coping is provided with a vinyl-liner, bead locking first channel and an elongated second channel disposed thereabove. One operative portion or component of a two-component, releasable locking member is disposed in the second channel and the cover as described in the first embodiment just above is releasably secured thereto.

In a third embodiment, a gunnite pool is provided with either a cantilevered deck having an edge extending over the water, or a straight vertical edge. The deck is poured against a form having a longitudinal projection which creates a trough or channel in the concrete edge. Thereafter, an operative portion or component of a two-component, releasable locking member is secured in the trough. The pool cover, as described in the preceding two embodiments, is releasably attached thereto.

In each of these embodiments, the pool cover is disposed across the top of the water, with its edges extending upwardly at the pool walls and continuously, releasably attached to the pool's upper edge. The cover preferably rests primarily on the water. With only several inches of vertical edge disposition, the weight of the cover hanging by the releasable locking members is small and the cover can easily be maintained in secure attached condition. No water bags or other hold downs are required. No tie-down points, screws, bolts or other latching members are necessary. The pool cover in each case does not extend onto the pool deck and does not trap moisture or debris against the deck surface, nor promote staining. Moreover, the retrofit embodiment does not require any construction around the pool, only insertion of the bead locking, cover latching member.

According to the invention, an improved pool cover apparatus is thus provided either for new vinyl-lined pools in construction, as a retrofit for existing vinyl-lined pools, or for gunnite pools.

These and other objectives and advantages will be readily apparent from the following description of various embodiments of the invention and from the drawings in which:

FIG. 1 is a perspective view of a pool and surrounding deck, the pool fitted with a cover according to the invention;

FIG. 2 is a cross-sectional view taken in lines 2—2 of the invention particularly adapted for retrofit to an existing vinyl-lined pool;

FIG. 6 is a diagrammatic view of a form used to define a cantilevered pool deck edge in the gunnite pool of FIG. 5.

DETAILED DESCRIPTION OF THE INVENTION

Figure 5:
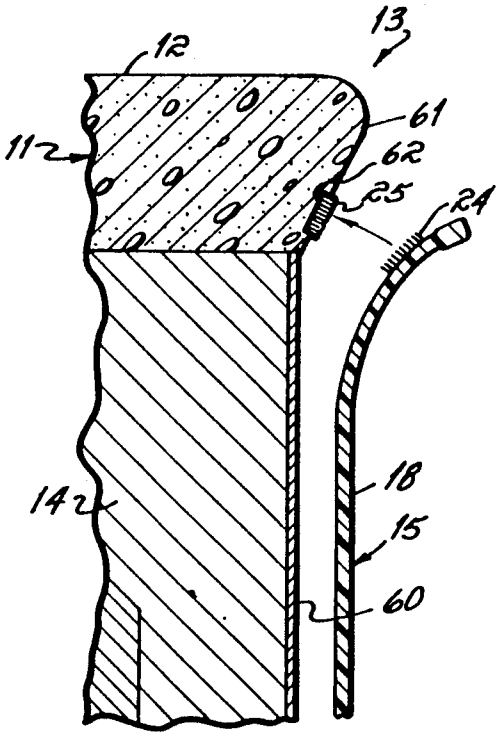
FIG. 5 is a cross-sectional view of the invention adapted for use with gunnite pools.

Turning now to the drawings that are shown in FIG. 1 a swimming pool with cover structure 10. The pool includes a pool deck 11 having an upper surface 12 surrounding the pool. The deck terminates inwardly and toward the interior of the pool at a curved deck edge 13 as diagrammatically shown in the figures. A pool cover 15 is disposed over the water of the pool. Pool cover 15 has a horizontally extending portion 17 and a vertically extending portion 18 as perhaps best seen in FIG. 2. The pool further has a plurality of pool walls 14 which may comprise concrete, gunnite, backfill, peat gravel, etc. In the case of some forms of vinyl-lined pools such as those shown in FIGS. 3 and 4 the pool wall may also include a steel plate 19.

In addition, and with reference to FIGS. 2, 3 and 4, vinyl-lined pools may also include a subdeck member 20 of any suitable material and construction for supporting the deck 11 and the edge coping, which may be disposed thereon as will be hereinafter described.

Turning now momentarily to cover 15 it will be appreciated that the invention contemplates the utilization of a multiple-component, releasable locking member for securing the cover 15 to the pool structure. Various releasable locking means could be utilized in this connection. Preferably, applicant contemplates the use of a two component, releasable locking means or member such as hook and loop fasteners of the type known as "Velcro" or other releasable elongated locking means such as the multiple-component "Duo-Lok" fastening apparatus produced by the 3M Company. Such two component elongated locking fasteners have a first component secured to one member and a second component secured to another member. The two components may be pushed together in order to releasably lock the two members together and may be pulled apart in order to release the engagement. Returning now momentarily to FIG. 2 for example, a first elongated component 24 of the two component elongated releasable locking member is positively secured to the cover 15. A second elongated component 25 of the two component locking member is secured to the pool structure as will be described. Accordingly, the cover 15 is secured on the pool by means of this locking member.

It will also be appreciated that the first elongated component 24 and the second elongated component 25 form the two component elongated locking member 26 and that each of the components 24 and 25 preferably extend respectively around the cover edge and around the edge of the pool. Nevertheless, it should be appreciated that one or the other of the components may not be continuous, and that short, cooperating sections of each of the components might be used even though preferably the entire edge of the cover is secured continuously around the edge of the pool.

Figure 3:
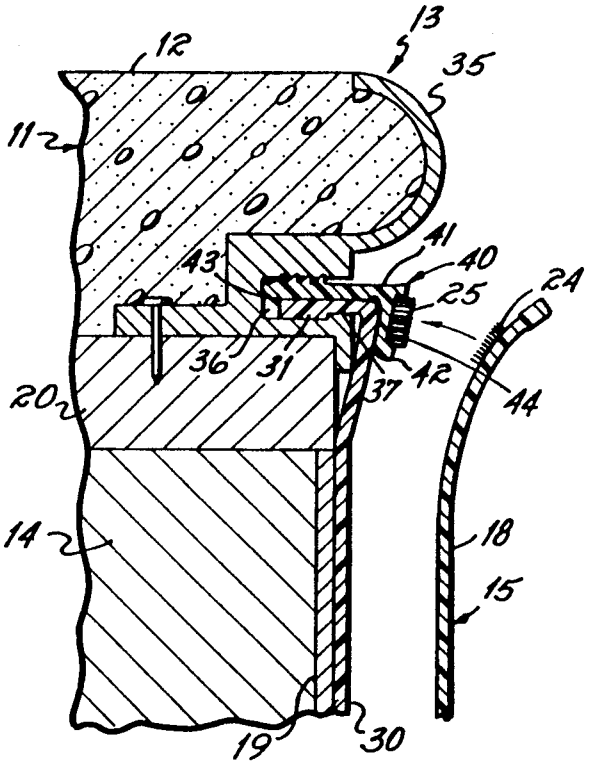
FIG. 3 is a cross-sectional view showing the pool cover of FIG. 2 separated from the pool side.

Turning now to FIGS. 2 and 3, there is disclosed therein structure which is adapted for retrofitting an existing vinyl-lined pool with a pool cover according to the invention. As shown in these two figures, the pools are provided with a vinyl liner 30. The pool construction as shown in FIG. 2 has a pool wall 14 of concrete or other material over which the liner 30 lies. As shown in FIG. 3, the pool wall includes a plate such as a steel plate 19 backed by concrete, backfill, pea gravel or the like. The vinyl liner 30 is provided with an enlarged edge bead 31 disposed around the edge of the liner. An edge coping 35 is disposed around the upper edge of the pool wall 14, 19. The coping is secured by any suitable known means to the subdeck 20 and is provided with an elongated channel 36 in which is disposed the edge bead 31. As shown the channel 36 is provided with a lip 37 to facilitate retention of the liner edge bead 31 within the channel, and the liner 30 thereby in place.

The coping 35 defines an interior edge of the deck 12, preferably curved as at 13. There is no provision however, in such construction as it may currently exist in any particular pool for the securement of the cover thereto.

According to the invention, a bead locking member 40 is provided for both locking the liner bead 31 in the channel 36 and for providing retrofit of apparatus for securing the pool cover to the pool. The bead locking member 40 includes a first horizontal leg or portion 41 and a second or vertical leg or portion 42. The horizontal leg 41 may have a depending elongated portion 43 to facilitate locking the bead locking member 40 and the bead 31 within the channel 36. The face of the second vertical leg 42 is provided with an elongated trough or channel 44 and one component 25, of the two component locking member 26, is positively secured to the bead locking member 40 as shown in FIGS. 2 and 3. Of course, it will be appreciated that FIG. 2 depicts the cover 15 in a releasably secured position as it would reside when the cover is in place. FIG. 3 illustrates the cover being separated from the releasable locking apparatus of the pool structure for the purposes of illustration.

It will also be appreciated that the channel 36 is disposed beneath the surface 12 of the deck 11 and that the peripheral edge area 18 of the cover 15 extends upwardly from the surface of the water 16 and terminates short of the deck surface 12 so that the cover does not lie on the deck surface.

Accordingly, the bead locking member as described is retrofitted to an existing vinyl-lined pool having a coping as described. The cover as described herein is utilized in conjunction therewith for providing a secure pool cover with elimination of any deck inserted tie-down points and without need to cover any of the pool deck with the pool cover itself such as might promote deck staining, degradation or the like. When in place, cover 15 resides on the surface of the water 16 and has a relatively small portion extending upwardly in engagement with the two component locking member. This securely fastens the cover in place around the pool for the prevention of the ingress of debris to the pool water and eliminates any undue strain on the two component locking member. It is believed that the contact of the cover 15 with the water surface 16 over substantially the entire pool serves to aid in maintaining the cover in place even in the presence of high winds while, of course, the edges of the cover are locked to the pool structure releasably.

Figure 4:
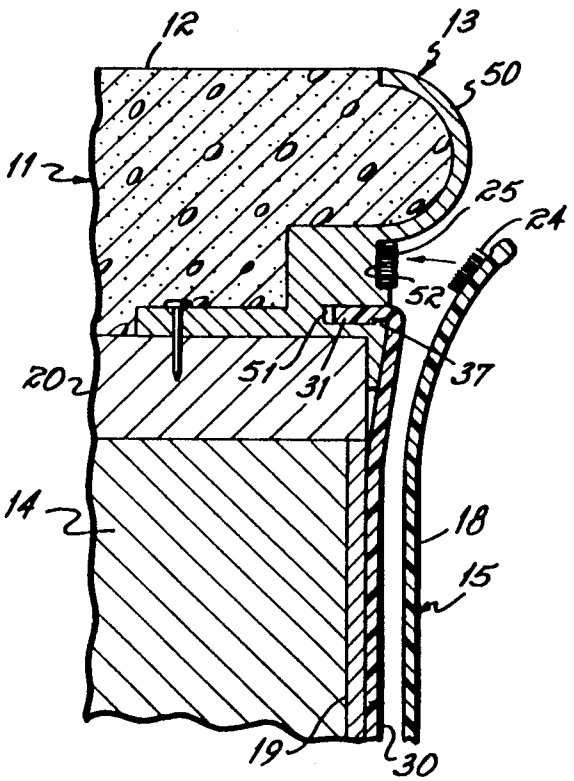
FIG. 4 is a cross-sectional view of the invention adapted for use in new pool construction.

Turning now to FIG. 4, there is disclosed therein a pool coping for use with newly constructed vinyl-lined pools adapted for the securement of a cover 15 to the pool structure. It will be appreciated that components with similar designation numbers in the drawings are similar to each other throughout the various embodiments.

In FIG. 4, a vinyl-lined pool is constructed having wall plates such as steel plates 19 therein backed up by concrete, backfill, pea gravel, or the like. A subdeck 20 is disposed on top of the wall and a coping 50 is disposed on the subdeck 20. Thereafter the deck 11 is poured with the coping forming the interior edge of the deck 11. The coping 50 includes a first lower channel 51 for receiving the bead 31 of the liner 30. The coping has a second upper channel 52 extending along the coping parallel to and above the lower channel 51. A component 25 of an elongated two component releasable locking member is secured in the channel 52 beneath the deck surface 12 but above the channel 31.

Once the pool has been constructed and the vinyl liner disposed with the bead 31 and channel 51, the pool is utilized. When it is desired to place the cover 15 thereon the cover is disposed across the top of the water in the pool and the upper edges 18 of the cover have secured thereto a second component 24 of the two component locking member. The component 24 is engaged operatively with the component 25 to secure and maintain the cover in place.

It will, of course, be appreciated in this embodiment and in the embodiment shown in FIGS. 2 and 3 that the components 25 are disposed in the bead locking member 40 and in the respective channel 52 such that each component is exposed to the interior of the pool. In this fashion, an improved pool construction and cover therefor is provided by means of the coping as described.

Turning now to FIGS. 5 and 6, there is disclosed therein an embodiment of the invention utilized in connection with a gunnite type pool having a layer of gunnite 60 formed over the pool wall 14. A deck 11 is poured on top of the wall 14 and terminates in a deck edge 61 in a preferably cantilevered fashion toward and over the pool. The deck 11 is of pourable material, such as cementitious material like concrete, and may have a pool decking surface formed from a thin coating of material thereon just as might be utilized in connection with the other embodiments. An elongated trough or channel 62 is disposed as shown in FIG. 6 in the deck edge 61. One component 25 of a two component locking member as described above is secured in the elongated channel 22 with another component of a two component locking member is secured at peripheral 18 of the cover 15 such that the cover can be secured to the pool structure by means of the releasable engagement of the components 24 and 25 as indicated in FIG. 5. It will be appreciated that the trough 62 is disposed in the deck edge 61 such that the component 25 is exposed to the interior of the pool just above the pool wall and below the deck surface 12.

Turning now to FIG. 6 there is shown diagrammatically therein a form 65 used in forming the deck edge 61 of the embodiment shown in FIG. 5. Form 65 is provided with a curve surface 66 defining the desired deck edge shown in FIG. 5. Surface 66 is provided with a projection 67 elongated in form parallel to the top edge of the pool wall 14. When the form is moved to the left as shown in FIG. 6 and positioned for forming the deck edge (and perhaps the pool wall as well) the pourable deck material is poured to form the deck 11 with the curved edge 66 of form 65 and a protrusion 67 defining the edge surface of the deck along the pool wall. Once the deck material has hardened to form the deck 11, the form 65 is removed, leaving the formed deck edge together with the trough or channel 62 formed therein for securement therein of the component 25 of the two component locking member. Again, while it may be suitable to make the protrusion 67 in a discontinuous format it is preferable to form a continuous elongated channel 22 around the pool for receiving continuous locking component 25.

Of course, a cover as described herein could be retrofit to an existing gunnite pool by adhesively securing one component of the releasable locking member to the deck edge or upper pool wall for cover attachment thereto.

Accordingly it will be appreciated that the invention contemplates several different embodiments, all of which provide an improved pool cover and releasable locking means for securing the cover to an existing vinyl-lined pool on a retrofit basis, to a newly constructed vinyl-lined pool, or to a gunnite pool. The upper surface of the cover terminates well short of the deck surface 12 preventing staining or deck degradation and eliminating the use of any deck surface tie-downs or water bags or the like while at the same time providing a secure pool cover to the pool surface.

It will be appreciated in each of these embodiments that the pool covers are similarly constructed, depending, of course, on size and shape of the pool.

These and other advantages and modifications will be readily apparent to those of ordinary skill in the art without departing from the scope of the invention, and the applicant intends to be bound only by the claims appended hereto.

What is claimed is:

1. A lined swimming pool and removable cover therefor comprising:

a first elongated channel disposed along an upper edge of said pool;

a pool liner having an edge bead disposed in said channel;

an insertable bead locking means inserted in said channel for locking said bead therein;

a first portion of a two component releasable locking means secured to said bead locking means outside said first channel and exposed to the interior of said pool;

a pool cover having dimensions sufficient for extension thereof from wall to wall across the pool;

said pool cover having peripheral edges, and a second portion of said two component releasable locking means secured to said peripheral edge of said cover and releasably engageable with said first portion outside said first channel for releasably securing said cover to said bead locking means outside said first channel and across said pool.

2. A swimming pool and removable cover as in claim 1 wherein said cover is sized to lie on water in said pool with said peripheral edges of said cover extending upwardly from said water proximate said first elongated channel.

3. In a lined swimming pool having walls and a deck edge along the upper portion of said walls, means for securing a cover to the pool and including, an elongated channel disposed in said deck edge, a pool liner having an edge disposed in said channel;

a liner edge locking means inserted into said channel with said liner edge for securing said liner edge therein, said locking means having a portion extending outside said channel;

a multiple component releasable cover locking means having at least first and second operative portions;

the first operative portion of said releasable locking means secured to said outward extending portion of said edge locking means outside said channel and exposed inwardly toward said pool;

said second operative portion adapted to be secured to the cover, said first operative portion of said releasable locking means being selectively releasably engageable, outside said channel, with the second operative portion of said releasable locking means for securing the cover to the pool.

4. A retrofit swimming pool cover and attachment apparatus for a vinyl-lined swimming pool having a channel around the upper edge thereof for receiving and holding an edge bead of a vinyl pool liner therein, said cover and attachment apparatus comprising in combination:

a pool cover having a peripheral edge;

an elongated, vinyl bead locking member insertable into said channel for holding said edge bead therein, said locking member having a first portion sized to extend into said channel for locking said bead therein and a second portion sized to extend outside said channel;

an elongated two-component releasable locking means, one component thereof secured to the peripheral edge of said cover and another component thereof secured to said second portion of said bead locking member for disposition outside said channel, said two components being selectively releasably engaged with each other for releasably securing said cover over a pool, between the walls thereof, when said locking member is inserted into said channel.

5. Apparatus for attaching a swimming pool cover on a vinyl-lined pool of the type having a coping with a channel for receiving and holding an edge bead of a pool liner at an upper portion of a pool wall, said apparatus comprising:

a releasable liner bead locking and pool cover attachment means for securing said pool liner and cover to said channel, said releasable locking and attachment means comprising a first leg portion sized to extend into said channel for locking said bead therein and a second leg portion connected to said first leg portion and sized to be disposed outside said channel, and a multiple component releasable locking member means for securing said pool cover to said releasable locking and attachment means, said releasable locking member means comprising a first component secured to said second leg portion for disposition outside said channel and adapted for selective releasable engagement outside said channel with a second operative component of said releasable locking member means attached to the pool cover for releasably securing the pool cover to the pool.

6. Apparatus as in claim 5 wherein said first leg includes means for locking said bead locking and pool cover attachment means, with said bead, in said channel.

7. A method of retrofitting an existing vinyl-lined swimming pool for a cover wherein the pool includes a channel around an upper portion thereof receiving an edge bead of a depending pool liner including the steps of:

inserting into said channel an elongated liner bead locking member having a first component of a multiple-component, releasable cover locking member secured thereto, disposing said first component outside said channel alongside said depending liner and exposing it to an interior of said pool, and releasably securing to said first component, outside said channel, a second component of said releasable cover locking member secured to the cover.

8. A method as in claim 7 further including the steps of:

disposing the swimming pool cover, having the second component of said releasable cover locking member secured proximate an edge thereof, over water in said pool and engaging said two components thereby releasably securing said cover to said pool proximate said channel.

9. Apparatus for securing a cover to a swimming pool of the type having a depending liner covering walls thereof, wherein said pool has an elongated channel extending around the pool proximate the upper edge of said walls, and said liner has an edge bead disposed in said channel for securing said liner in place, the improvement comprising:

a liner bead locking means for securing said liner bead in said channel, said liner bead locking means having a first portion sized to be disposed at least partially within said channel for locking said liner bead therein and a second portion sized to be disposed outside said channel alongside said depending liner;

a two component releasable cover locking means for securing said pool cover to said liner bead locking means, said second portion of said liner bead locking means including a first component of said two component releasable cover locking means, a second component of said two component releasable cover locking means adapted to be attached to the cover, wherein said two components of said cover locking means are selectively and releasably connectable together outside said channel to secure said second component and the cover attached thereto over said pool.

10. Apparatus as in claim 9 wherein said cover has a shape similar to that of said pool, but is larger such that said cover extends from proximate said channel downwardly to lie on the surface of water in said pool when said two components are releasably secured together.

11. Apparatus for releasably securing a pool cover to a pool of the type having a liner with an edge bead disposed in an elongated channel and bead lock means for locking said bead therein, said apparatus comprising a liner bead lock means for securing said liner bead in said channel, said liner bead lock means having a first portion sized to be disposed within said channel to lock said liner bead therein, and a second portion sized to be disposed outside said channel, said bead lock means second portion including a first component of a two component releasable cover locking means secured thereto;

a second component of said two component releasable cover locking means adapted for securement to the cover for said pool and;

said two components being releasably attached such that said second component is disposed entirely outside said channel to secure said cover over said pool when said bead lock means is disposed in said channel and said cover is disposed over said pool.

12. A liner bead locking means for use in a pool of the type having a depending wall liner with an edge bead disposed in a groove oriented around the top of the swimming pool walls and for securing a cover over said pool, said liner bead locking means being insertable into said groove for locking said bead therein and said liner bead locking means having one portion sized to be disposed alongside said depending liner outside said groove and carrying means for releasable attachment thereof to a pool cover for securing said cover to said pool outside said groove.

13. A combined liner locking and cover securing apparatus for swimming pools of the type having lined pool walls and a groove around an upper edge of said walls for securing an edge bead of a depending liner therein, said apparatus comprising;

a bead locking means for securing said liner bead in said groove, said bead locking means having at least a first portion adapted for insertion into said groove to lock the bead of a depending liner therein, and further having a second portion sized to be disposed outside said groove, said second portion having one surface sized to be disposed alongside said depending liner and a second surface thereof having thereon a first component of a multiple component, releasable cover locking means thereon adapted for releasable connection outside said groove to a cover for holding said cover on said pool.

14. Apparatus for attaching a swimming pool cover on a vinyl-lined pool of the type having a coping with a channel for receiving and holding an edge bead of a pool liner at an upper portion of a pool wall, said apparatus comprising:

a releasable liner bead locking and pool cover attachment means for securing said pool liner and cover to said channel, said releasable locking and attachment means comprising a first leg portion sized to extend into said channel for locking said bead therein and a second leg portion connected to and being substantially perpendicular to said first leg portion and sized to be disposed outside said channel, said second leg portion having an elongated trough, and a multiple component releasable locking member means for securing said pool cover to said releasable locking and attachment means, said releasable locking member means comprising a first component secured to said second leg portion in said trough for disposition outside said channel and adapted for operative engagement outside said channel with a second operative component of said releasable locking member means attached to the pool cover for releasably securing the pool cover to the pool.

* * * * *